US010898821B2

(12) United States Patent
Poulus et al.

(10) Patent No.: US 10,898,821 B2
(45) Date of Patent: Jan. 26, 2021

(54) ADHESIVE TOY BEADS

(71) Applicant: MOOSE CREATIVE MANAGEMENT PTY LIMITED, Cheltenham (AU)

(72) Inventors: Joost Sebastiaan Poulus, Elsternwick (AU); Nicholas St Clair Max Heine, St Kilda West (AU); Michael Boye Pagh, Ringwood Nth. (AU)

(73) Assignee: Moose Creative Management Pty Limited, Cheltenham (AU)

( * ) Notice: Subject to any disclaimer, the term of this patent is extended or adjusted under 35 U.S.C. 154(b) by 0 days.

(21) Appl. No.: 14/728,933

(22) Filed: Jun. 2, 2015

(65) Prior Publication Data

US 2016/0354705 A1 Dec. 8, 2016

(51) Int. Cl.

| | |
|---|---|
| ***A63H 33/14*** | (2006.01) |
| ***A63H 33/08*** | (2006.01) |
| ***A63H 33/04*** | (2006.01) |

(52) U.S. Cl.

CPC ..... *A63H 33/14* (2013.01); *A63H 33/04* (2013.01); *A63H 33/086* (2013.01)

(58) Field of Classification Search

CPC ..... A63H 33/04; A63H 33/001; A63H 33/06; A63H 33/14; A63H 33/32; A63H 33/086; A63F 9/06; B44C 3/12; B44C 3/123; B44C 3/04; A44C 27/00

See application file for complete search history.

(56) References Cited

U.S. PATENT DOCUMENTS 1,205,522 A * 11/1916 Doerr ..... A21B 3/13 211/85.4
2,463,270 A 3/1949 Hirsch
3,057,625 A 10/1962 Livingston
(Continued)

FOREIGN PATENT DOCUMENTS

AT DE 19963494 C1 * 6/2001 ..... A45C 13/08
CN 201052418 Y * 4/2008
(Continued)

OTHER PUBLICATIONS

Hickey, "International Playthings Announces New Aquabeads", Press Release by International Playthings, dated Jan. 2014, 4 pages.
(Continued)

*Primary Examiner* — Eugene L Kim
*Assistant Examiner* — Alyssa M Hylinski
(74) *Attorney, Agent, or Firm* — Knobbe Martens Olson & Bear, LLP

(57) ABSTRACT

Disclosed are toy systems for creating and fixing an array of polygon shaped plastic beads together to form a design. The toy systems can include a tray, a plurality of beads, and a template. The plurality of beads can engage pins on the surface of the tray. Each of the beads can be configured to fuse or adhere to adjacent beads upon drying after the application of liquid to the plurality of beads engaged to the tray, forming a fixed array of beads. The template can be configured to engage the pins of the tray between the tray and the plurality of beads. The template can provide a design for the plurality of beads and can be used to remove a fixed or loose array of beads from the tray.

20 Claims, 8 Drawing Sheets

(56) References Cited

U.S. PATENT DOCUMENTS

| | | | | | |
|---|---|---|---|---|---|
| 3,579,859 | A | | 5/1971 | Malenge | |
| 3,721,022 | A | | 3/1973 | Mercorelli | |
| 3,827,774 | A | * | 8/1974 | Reiling, Jr. | A63F 3/0415 312/230 |
| 3,921,330 | A | * | 11/1975 | Drieze | A63F 9/06 273/157 R |
| 3,987,558 | A | * | 10/1976 | Tsukamoto | A63H 33/22 434/96 |
| 4,183,167 | A | * | 1/1980 | Jatich | A63F 9/0073 446/118 |
| 4,317,306 | A | * | 3/1982 | Hotti | A63H 33/105 446/126 |
| 4,798,292 | A | | 1/1989 | Hauze | |
| 4,986,756 | A | | 1/1991 | Yamaguchi | |
| 5,061,218 | A | * | 10/1991 | Garage | A63H 33/086 446/102 |
| 5,098,676 | A | | 3/1992 | Brooks, Jr. | |
| 5,176,521 | A | * | 1/1993 | McRae | G09B 1/10 434/200 |
| 5,661,941 | A | * | 9/1997 | Vataker | A63H 33/086 52/604 |
| 5,704,789 | A | | 1/1998 | Yang | |
| 5,769,681 | A | * | 6/1998 | Greenwood, Sr. | A63H 33/101 446/120 |
| 5,788,556 | A | * | 8/1998 | Morace | A63H 33/22 362/551 |
| 6,340,323 | B1 | * | 1/2002 | Glynn | A63H 18/04 40/406 |
| 6,481,235 | B2 | | 11/2002 | Kwon | |
| 8,360,238 | B2 | | 1/2013 | Nicoletti | |
| 9,770,648 | B1 | * | 9/2017 | Nelson | A63F 9/0612 |
| 2003/0207647 | A1 | * | 11/2003 | Jarvis | A63H 33/22 446/219 |
| 2003/0214077 | A1 | | 11/2003 | Unterlander et al. | |
| 2005/0227573 | A1 | | 10/2005 | Lin | |
| 2007/0017885 | A1 | | 1/2007 | Taike et al. | |
| 2007/0031532 | A1 | | 2/2007 | Chen | |
| 2007/0102843 | A1 | | 5/2007 | Waatti | |
| 2008/0011770 | A1 | * | 1/2008 | Tobias | B44B 9/00 221/189 |
| 2009/0298382 | A1 | * | 12/2009 | Ochi | A63H 33/086 446/121 |
| 2010/0289215 | A1 | | 11/2010 | Tan et al. | |
| 2010/0294734 | A1 | | 11/2010 | Taike | |
| 2010/0311299 | A1 | * | 12/2010 | Rath | A63H 33/14 446/87 |
| 2011/0073519 | A1 | | 3/2011 | Davis et al. | |
| 2011/0124263 | A1 | * | 5/2011 | Cheng | A63F 9/06 446/118 |
| 2011/0192544 | A1 | | 8/2011 | Reynolds | |
| 2012/0164424 | A1 | * | 6/2012 | Vicari | C08F 218/08 428/220 |
| 2012/0186748 | A1 | * | 7/2012 | Kamiyama | B44C 3/12 156/349 |
| 2013/0026337 | A1 | | 1/2013 | Svensson | |
| 2013/0183881 | A1 | * | 7/2013 | Kamiyama | A63F 9/06 446/87 |
| 2013/0189650 | A1 | | 7/2013 | Lee et al. | |
| 2014/0120501 | A1 | * | 5/2014 | Cooke | A63H 9/06 434/81 |
| 2014/0127471 | A1 | | 5/2014 | Matsubara et al. | |
| 2014/0154722 | A1 | | 6/2014 | Yeal et al. | |
| 2014/0182325 | A1 | | 7/2014 | Lee et al. | |
| 2015/0060303 | A1 | | 3/2015 | Blohm | |
| 2016/0271510 | A1 | * | 9/2016 | Ho | A63H 33/14 |

FOREIGN PATENT DOCUMENTS

| | | | | | |
|---|---|---|---|---|---|
| CN | 201201471 | Y | * | 3/2009 | |
| CN | 101439233 | A | | 5/2009 | |
| CN | 103203106 | A | | 5/2012 | |
| DE | 35 19 187 | A1 | | 12/1986 | |
| DE | 20 2015 00053 | | | 2/2015 | |
| EP | 1847404 | A2 | * | 10/2007 | B44B 9/00 |
| JP | 2003304913 | A | * | 10/2003 | |
| JP | 3131292 | U | * | 4/2007 | |
| JP | 2009125232 | A | * | 6/2009 | |
| JP | 2011139820 | A | * | 7/2011 | |
| JP | 2012232002 | A | | 11/2012 | |
| WO | WO 1989/007001 | A1 | | 8/1989 | |
| WO | WO 8907001 | A1 | * | 8/1989 | A63F 9/06 |
| WO | WO 2014/070743 | A1 | | 5/2014 | |

OTHER PUBLICATIONS

Moose Toys, "Beados™ Scores Top Honor on Walmart's List of Top Toys for Holidays", PRNewswire, dated Sep. 10, 2014, 3 pages.

Product image (1 of 2) from Epoch Co., Ltd. for Aquabeads.

Product image (2 of 2) from Epoch Co., Ltd. for Aquabeads.

2007 Moose Product Catalogue featuring Bindeez Magic Bead Toys.

*Epoch Company Limited*V. *Character Options Limited,*Defendant's Notice of Experiments, Case IP-2015-000153, UK Patent No. 2498410B, dated Jun. 3, 2016.

*Epoch Company Limited*V. *Character Options Limited,*Joost Poulus Witness Statement, Case IP-2015-000153, UK Patent No. 2498410B, dated Sep. 21, 2016.

*Epoch Company Limited*V. *Character Options Limited,*Judgement, Case IP-2015-000153, UK Patent No. 24984108, entered Mar. 22, 2017.

*Epoch Company Limited*V. *Character Options Limited,*Stephen Daniel Tull Witness Statement, Case IP-2015-000153, UK Patent No. 2498410B, dated Sep. 22, 2016.

Malte Haaning Plastics A/S, "Hama a concept"[listed in the International Search Report in Application No. PCT/AU2016/050448 (Cite No. 4) as retrieved from internet on Jun. 20, 2016]<URL:http://web.archive.org/web/20110808175209/http://viewer.doomags.com/1993/>published on Aug. 8, 2011 as per Wayback Machine.

Mattel Inc, "Crafting table Instructions, Mattel Crafting Cubes Design Kit"[listed in the International Search Report in Application No. PCT/AU2016/050448 (Cite No. 4) as retrieved from internet on Jun. 23, 2016]<URL: http://service.mattel.com/instruction_sheets/CJM12_Eng.pdf>.

Moose Japanese Catalogue featuring product Aquabeads Fine with translation.

Toy Yak, "Qixels from Moose Toys First Look at New York Toy Fair 2015"[listed in the International Search Report in Application No. PCT/AU2016/050448 (Cite No. 4) as viewed on the internet on Jun. 20, 2016]<URL: http://www.youtube.com/watch?v=5uRYLXGYz60>Published on Feb. 23, 2015.

International Search Report dated Jul. 19, 2016 in Application No. PCT/AU2016/050448, filed Jun. 2, 2016.

Written Opinion of the International Search Authority dated Jul. 19, 2016 in Application No. PCT/AU2016/050448, filed on Jun. 2, 2016.

Extended European Search Report for Application No. 16802253.1; dated May 7, 2018.

Chinese Office Action, dated Oct. 11, 2019 for CN application No. 201680032574.4.

* cited by examiner

ADHESIVE TOY BEADS

BACKGROUND OF THE INVENTION

Field of the Invention

This invention relates to toy assemblies, and more particularly, relates to toy assemblies for creating designs out of beads fused together by drying after applying liquid to the beads.

Description of the Related Art

Toy assemblies can allow for the creation of a structure out of multiple components. Assemblies may include several interlocking pieces that can be attached and detached. Components may also be attached by applying an adhesive, by heating the pieces to fuse pieces together using heat sources such as an iron or oven, or by engaging multiple components with a connecter such as a string, wire, thread, screw, or fastener.

SUMMARY

In certain embodiments, a system for creating and fixing an array of polygon shaped plastic beads together to form a design is disclosed. The system includes a tray having a plurality of pins disposed on a surface of the tray and a plurality of polygon shaped beads. Each of the beads includes a receptacle configured to receive one of the plurality of pins so as to anchor to the tray and form an array of beads. Each bead is sized and shaped to achieve sufficient contact with an adjacent bead so as to adhere to the adjacent bead once dry after a liquid is applied to the array.

Embodiments further include a template having a plurality of apertures arranged so as to register with the plurality of pins when the template is disposed on the tray and below the plurality of beads. The template can also include a design configured to guide the placement of the plurality of beads. The tray and template can also be configured so that when the template is engaged to the tray, the design is oriented in a particular direction on the tray. The system can also be configured so that removal of the template from the tray causes the removal of the plurality of beads from the tray.

The tray, template, and beads may further be configured to allow for the draining of liquid from the system. The tray may have multiple perimeter members to allow for draining from the tray. The beads may have a plurality of dimples configured to engage the tray or template to allow for the flow of liquid between the beads and the tray or template. The beads may also include one or more shaped edges to facilitate the flow of liquid between beads and between the beads and the tray or template.

In another embodiment, a toy system for creating and fixing an array of polygon shaped plastic beads together to form a design is disclosed. The system includes a tray having a plurality of pins disposed on a surface of the tray and a plurality of beads made from a material. Each bead has a plurality of planar outer surfaces and a receptacle. The receptacle is configured to receive one of the plurality of pins so as to anchor to the tray and form an array. Each of the plurality of planar outer surfaces is configured to achieve sufficient contact with an adjacent bead so as to adhere to the adjacent bead when dry after a liquid is applied to the array.

In another embodiment, a bead for fusing together with an adjacent bead is disclosed. The bead has a body with a plurality of planar outer surfaces and a receptacle. The receptacle is configured to releasably receive a pin. Each of the plurality of planar outer surfaces is configured to achieve sufficient contact with an outer surface of an adjacent bead so as to adhere to the adjacent bead when dry after a liquid is applied to the bead and the adjacent bead.

In another embodiment, a toy system for creating and fixing an array of polygon shaped plastic beads together to form a design is disclosed. The system includes a tray having an upper surface and a plurality of polygon shaped beads made from a material. Each bead is sized and shaped to achieve sufficient contact with an adjacent bead so as to adhere to the adjacent bead when dry after a liquid is applied to the plurality of beads when the plurality of beads is arranged to form an array on the upper surface of the tray.

BRIEF DESCRIPTION OF THE DRAWINGS

The features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will now be described with additional specificity and detail through use of the accompanying drawings.

DETAILED DESCRIPTION

The following detailed description is directed to certain specific embodiments. The invention(s) disclosed herein, however, can be embodied in a multitude of different ways as defined and covered by the claims. In this description, reference is made to the drawings, wherein like parts are designated with like numerals throughout. The features, aspects and advantages of the present invention will now be described with reference to the drawings of several embodiments that are intended to be within the scope of the development herein disclosed. These and other embodiments will become readily apparent to those skilled in the art from the following detailed description of the embodiments having reference to the attached figures, the invention not being limited to any particular embodiment(s) herein disclosed.

Figure 1:
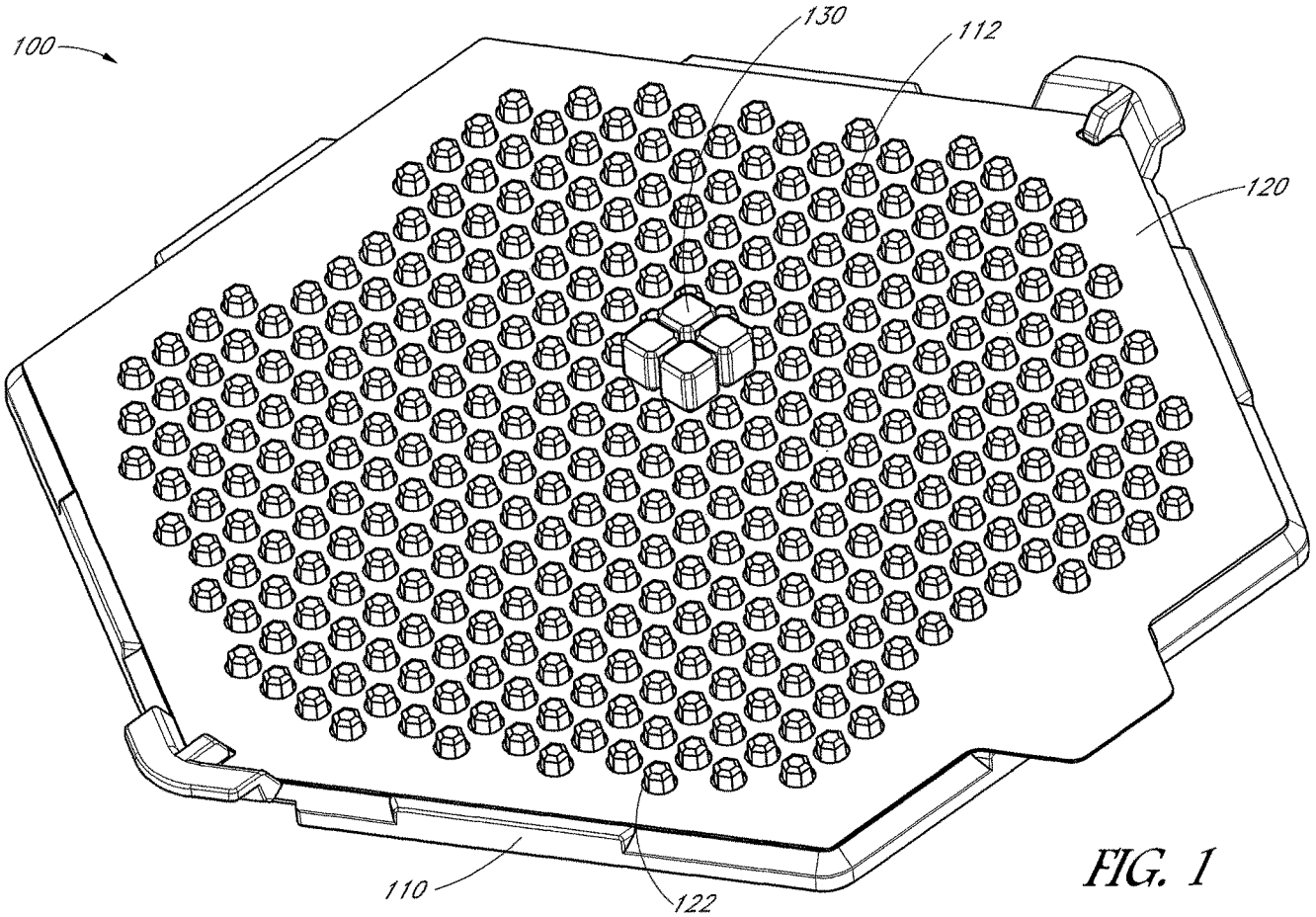
FIG. 1 is a perspective view of a toy system according to a preferred embodiment of the present invention.

FIG. 1 illustrates an embodiment of a toy system 100. Certain embodiments of the toy system 100 include a tray 110, a template 120, and a plurality of beads 130. During use, each of the plurality of beads 130 is arranged to create a desired design on the tray 110 by engaging the bead with a pin 112 at a desired location on the tray 110. Liquid is then applied to the design of beads 130. Once dry, the beads 130 of the design are fused together. In certain embodiments, the template 120 is disposed between the tray 110 and the plurality of beads 130. In certain embodiments, the template 120 provides a guide or design for the user when locating beads 130 on the pins 112 to achieve the desired design. The template 120 can include colored regions to guide placement of correspondingly colored beads 130. In certain embodiments, the template 120 is sized and shaped so that the template 120 facilitates removal of fused beads 130 from the tray 110. Of course the toy system 100 need not include the template 120 and can be used by placing the beads 130 directly on the tray 110.

The tray 110 includes a plurality of pins 112 extending from an upper surface of the tray 110. The template 120 includes a plurality of apertures 122. The plurality of pins 112 is configured to receive the plurality of apertures 122 and then engage with the plurality of beads 130. The template 120 can removably receive the plurality of pins 112. The beads 130 can removably engage the plurality of pins 112, both when the template 120 is engaged to the plurality of pins 112 and in the absence of the template 120. FIG. 1 shows the plurality of pins 112 of the tray 110 extending through the plurality of apertures 122 in the template 120. Four adjacent beads 130 are engaged with four pins 112. The template 120 is positioned on the tray 110 and below the four beads 130.

The plurality of beads 130 can be made of a material that is water soluble. When liquid is applied to the beads 130, the wetted outer surfaces of the beads 130 adhere to adjacent and contacting surfaces of beads 130 by partially dissolving. Exemplary materials for the beads 130 include inert plastic materials. The beads 130 may further include an embittering agent to make the beads 130 unpalatable to the user. Liquid may be applied to the plurality of beads 130 as a spray or mist. Liquid can also be applied by contacting the beads 130 with a liquid imbued material such as a sponge or rag. In certain embodiments, the array of beads 130 on the tray 110 may be submerged in a pool of liquid or may be translated across a fluid path such as an outflow of water from a faucet or hose.

Each of the plurality of beads 130 can be sized and shaped to achieve contact with one or more adjacent contacting beads 130 so as to adhere to the one or more adjacent beads 130 once dry after liquid is applied, allowing for the formation of a fused array of beads 130. The fused array of beads 130 adhere between surfaces of adjacent contacting beads 130. The template 120 can be configured to facilitate removal of the plurality of beads 130 from the tray 110. For example, when removing the template 120 when the template 120 is positioned between the tray 110 and the plurality of beads 130, a top surface of the template contacts a bottom surface of the plurality of beads 130. As the template 120 is pulled away from the top surface of the tray 110, the template 120 causes the plurality of beads 130 to slide towards a distal end of the plurality of pins 112 and eventually disengage from the pins 112.

The template 120 and the plurality of beads 130 can be configured so that minimal or no adhesion occurs between the plurality of beads 130 and the template 120, allowing for the removal of the fused array of beads 130 from the template 120 after the template 120 is removed from the tray 110.

Figure 2:
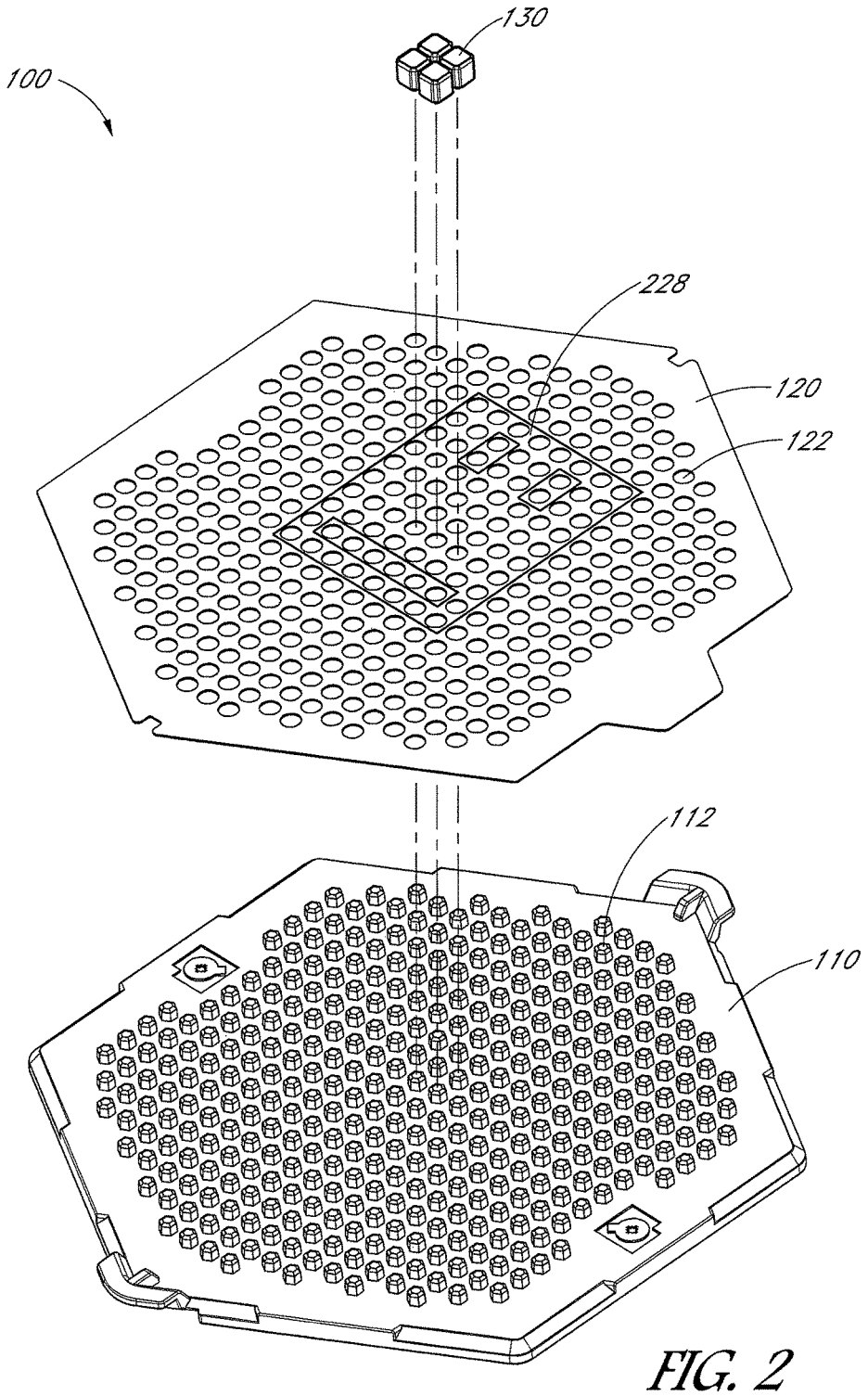
FIG. 2 is an exploded view of the toy system of FIG. 1 which includes a tray, a template, and a plurality of beads.

FIG. 2 illustrates an exploded view of the toy system 100 from FIG. 1. The toy system 100 includes the tray 110, the template 120, and the plurality of beads 130. The template 120 preferably includes a design 228. The design 228 can be configured to guide the placement of the plurality of beads 130 onto one or more of the plurality of pins 112 so that a fixed array of beads 130 can be formed in accordance with the design 228. Lines and other elements of the design 228 can be located amidst the plurality of apertures 122 so that the plurality of beads 130 can engage the plurality of pins 112 through the plurality of apertures 122 in accordance with the design 228. When a liquid, for example water, is administered to the plurality of beads 130, the plurality of beads 130 will fuse or adhere together once dry to form an array of beads representative of the design 228. The design 228 may include color to indicate which color of bead 130 should be engaged with a specific pin 112. In some embodiments, the template 120 includes a design on both the front and back surfaces of the template 120. In some embodiments, the template 120 will be configured to allow for writing, drawing, or printing so that a design can be customized by the user. For example, a software application can be used to create a design, such as design 228. The design can be printed on to the template 120. The software application may be internet based and can allow for the sharing of designs 228. It should be recognized that the design 228 need not be present in order for an array of beads to be formed.

Figure 3:
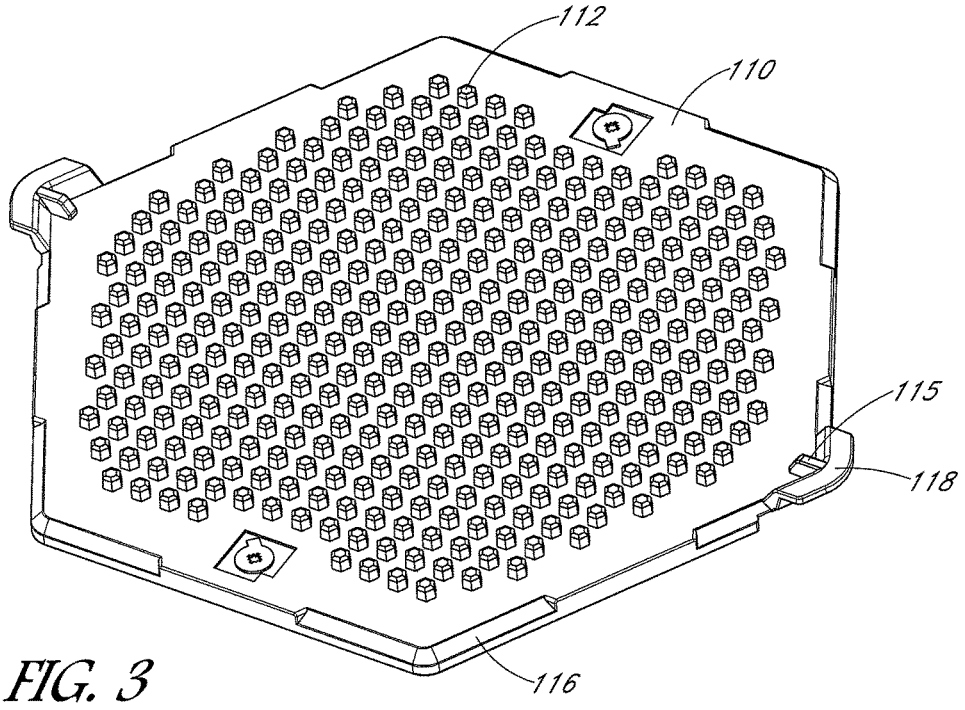
FIG. 3 is a top perspective view of the tray from FIG. 2.
Figure 4:
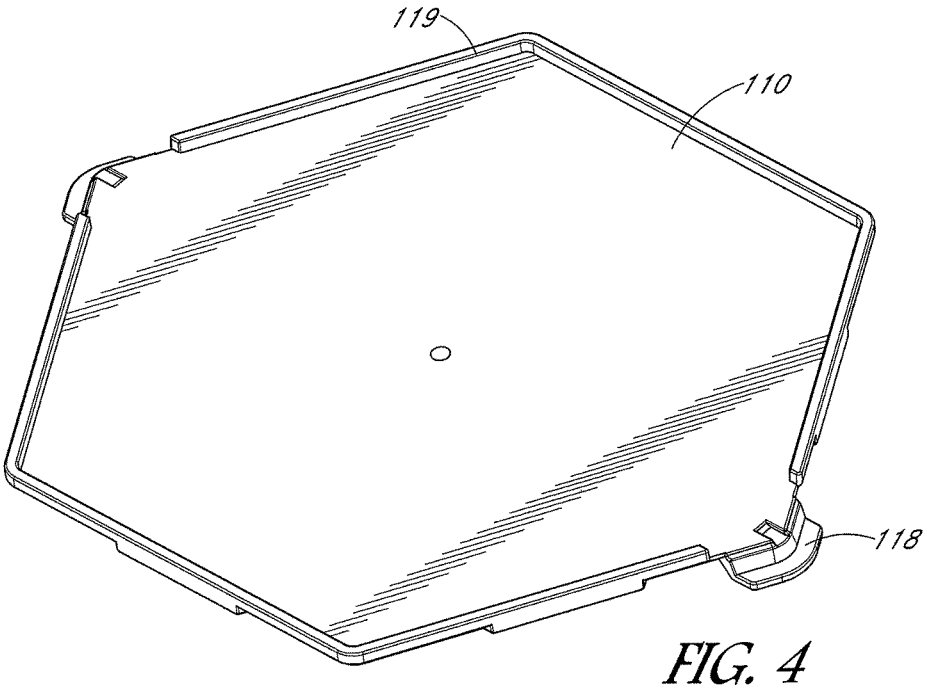
FIG. 4 is a bottom perspective view of the tray of FIG. 3.
Figure 5:
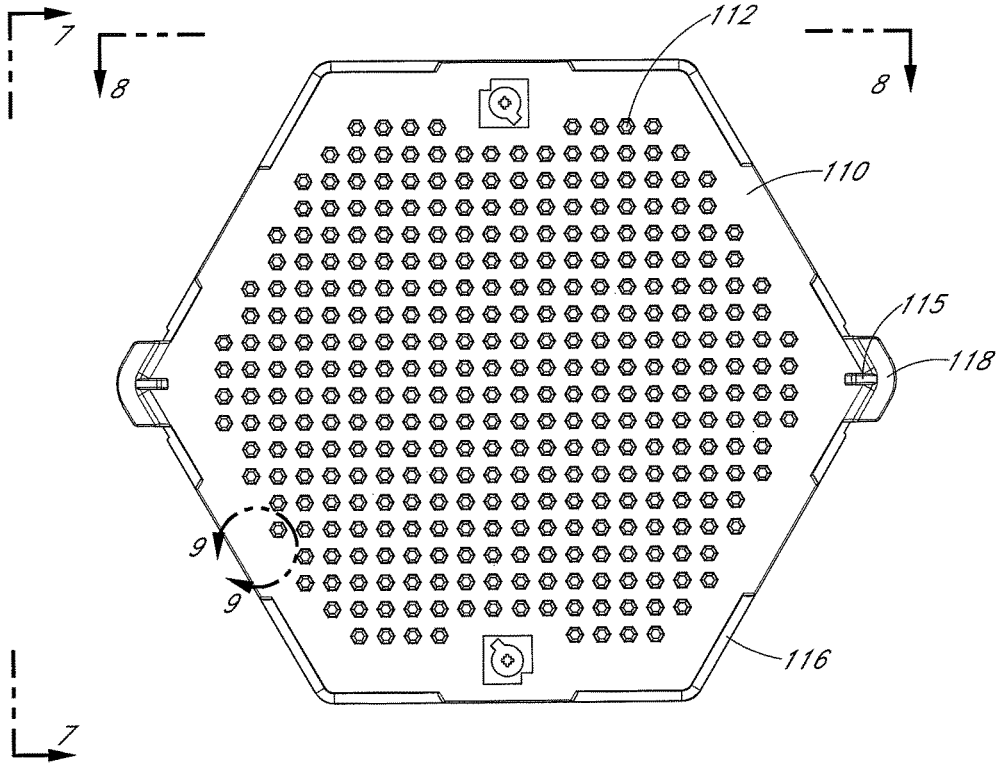
FIG. 5 is a top view of the tray of FIG. 3.
Figure 6:
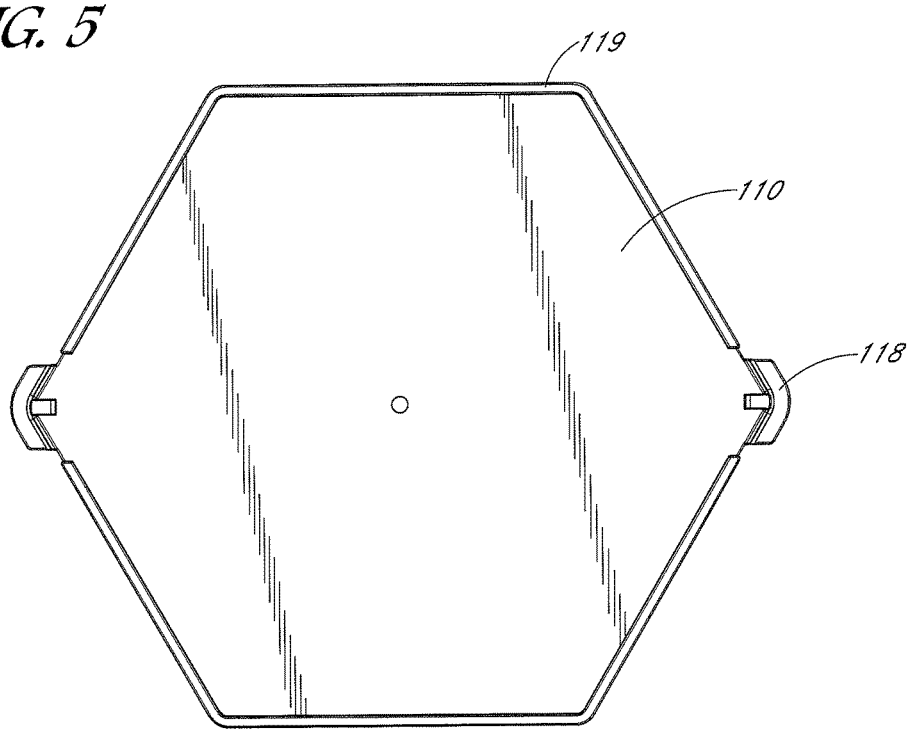
FIG. 6 is a bottom view of the tray of FIG. 3.
Figure 7:
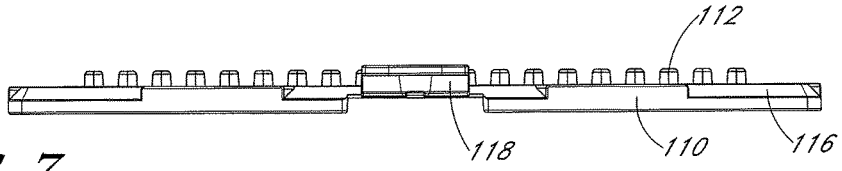
FIG. 7 is a side view of the tray of FIG. 5 taken along lines 7-7 as depicted in FIG. 5.
Figure 8:
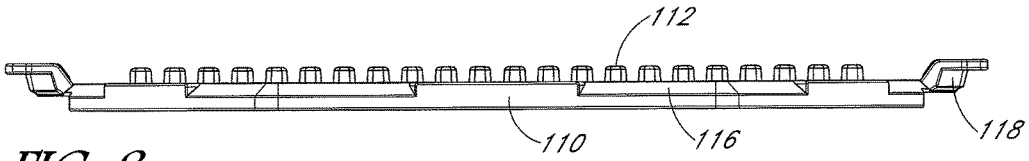
FIG. 8 is a side view of the tray of FIG. 5 taken along lines 8-8 as depicted in FIG. 5.

FIGS. 3-8 illustrate the tray 110 from FIG. 2. FIG. 3 illustrates a perspective view of the top of the tray 110. FIG. 4 illustrates a perspective view of the bottom of the tray 110. FIGS. 5 and 6 illustrate a top and a bottom view, respectively, of the tray 110. FIG. 7 is a side view of the tray 110 of FIG. 5 taken along lines 7-7 as depicted in FIG. 5. FIG. 8 is a side view of the tray 110 of FIG. 5 taken along lines 8-8 as depicted in FIG. 5. The tray 110 includes the plurality of pins 112. In certain embodiments, the tray 110 includes one or more protrusions 115 positioned on the top surface of the tray 110. In certain embodiments, the tray 110 includes one or more perimeter members 116, one or more handles 118, and one or more lip members 119.

The plurality of pins 112 can be disposed on the tray 110 in a 2D array of rows and columns. In certain embodiments, the pins 112 have a variable length so that the beads 130 can be arranged in three dimensions. The plurality of pins 112 can also be spaced so that one or more side surfaces of a bead in the plurality of beads 130, as depicted in FIG. 1, contact the side surfaces of adjacent beads 130 when the beads 130 are anchored to the plurality of pins 112.

The protrusions 115 can be configured to engage the template 120, as shown in FIG. 1. When engaged, the protrusions 115 can inhibit rotary movement of the template 120 relative to the tray 110 as well as provide guidance for the user to correctly align the template 120 on the top surface of the tray 110 during engagement. In some embodiments, the protrusions 115 may include one or more movable pieces, and can be configured to prevent movement in one or more directions. The moveable pieces can be configured to allow for release of the template 120 upon application of force to one or more of the movable pieces. In an alternative embodiment, the protrusions 115 can be configured to include an open slot between the protrusions 115 and the tray 110 allowing for the insertion of sections of the template 120 into the slots.

The handles 118 facilitate the user moving the tray 110. The lip members 119 can be configured to provide support for the tray 110. For embodiments where the handles 118 are disposed on the top of the lip members 119, the lip members 119 increase the height of the handles 118. A gap may be provided between the lip members 119 at the location of the handles 118 to allow for access to the bottom of the handle 118.

The perimeter members 116 can be configured to allow liquid to drain from the tray 110. The perimeter members 116 may also be configured to allow access to the bottom of the template 120 when the template 120 is placed on the tray 110.

In some embodiments, the tray 110 may further include one or more drains configured to allow excess liquid to pass through the tray 110. The one or more drains may be located between some of the plurality of pins 112, or on the surface of the tray 110 around the periphery of the plurality of pins 112. In some embodiments, the tray 110 can further include one or more removable stoppers configured to open and close the one or more drains. The one or more stoppers may be configured to rotate across a surface of the tray 110 to allow or block flow of liquid through the one or more drains. The one or more stoppers may be oriented on either a top or bottom surface of the tray 110. The tray 110 may further include one or more receptacles or recesses for collecting excess liquid below the top surface of the tray 110.

In certain embodiments, the tray 110 may not comprise a plurality of pins 112, but instead, the plurality of beads 130 may be placed on a surface of the tray 110. The surface of the tray 110 can include an adhesive material, such as a putty, for releasably fixing the beads 130 into an array on the tray 110. Alternatively, the adhesive material may be attached to a surface of each of the plurality of beads 130 or may be a separate component that can be applied to either the tray 110 or to the plurality of beads 130.

In certain embodiments, the tray 110 can comprise a plurality of channels, wherein each bead 130 can be inserted into one of the plurality of channels and the orientation of the tray 110 can be altered to allow for translational movement of the bead 130 within the channel due to the effects of gravity. Each channel can be configured to restrict the movement of the beads 130 in one or more directions. One or more channels may also be configured to allow for the application of liquid to the array of beads 130.

In some embodiments, the tray 110 may be made of a transparent or semi-transparent material. The tray 110 can also include a design on the surface of the tray 110. The design can be configured to guide the placement of the plurality of beads 130 onto one or more of the plurality of pins 112 so that a fixed array of beads can be formed in accordance with the design. In such an embodiment, the template 120 need not be used.

In some embodiments, the plurality of pins 112 can be configured so that the tops of the plurality of pins 112 are located at different heights such that the differences in height of adjacent pins 112 is small enough to allow for the side surfaces of each bead 130 to contact the side surfaces of one or more adjacent beads 130.

Figure 9:
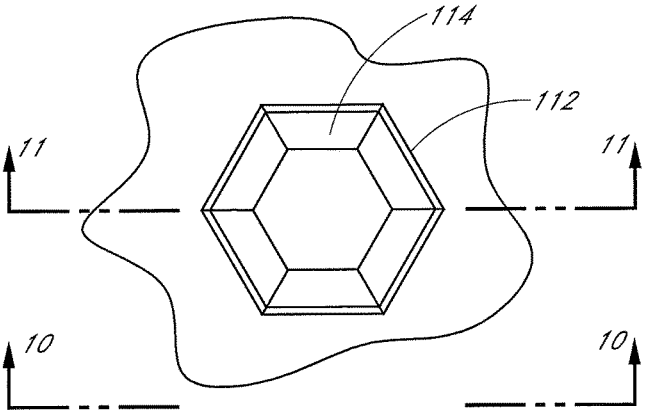
FIG. 9 is an enlarged top view of a pin of the tray of FIG. 5 taken along line 9-9 as depicted in FIG. 5.
Figure 10:
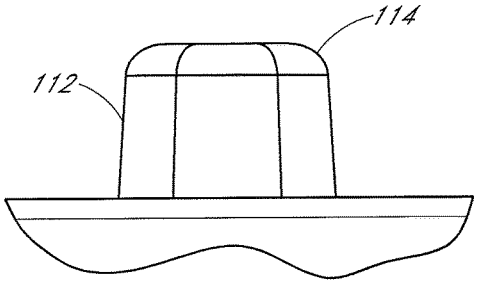
FIG. 10 is a side view of the pin of FIG. 9 taken along line 10-10 as depicted in FIG. 9.
Figure 11:
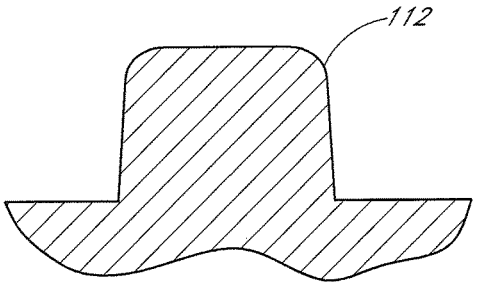
FIG. 11 is a cross-sectional view of the pin of FIG. 9 taken along line 11-11 as depicted in FIG. 9.

FIGS. 9-11 illustrate an embodiment of one of the plurality of pins 112. FIG. 9 illustrates a top view of one of the plurality of pins 112 taken along line 9-9 as depicted in FIG. 5. FIG. 10 illustrates a side view of one of the plurality of pins 112 taken along line 10-10 as depicted in FIG. 9. FIG. 11 illustrates a cross-section view of one of the plurality of pins 112 taken along line 11-11 as depicted in FIG. 9.

Each of the plurality of pins 112 can be configured to engage an aperture of the plurality of apertures 122 and a bead of the plurality of beads 130. In certain embodiments, the plurality of pins 112 may include one or more chamfered or radiused edges, such as shaped edge 114. The shaped edge 114 forms a transition surface between surfaces or vertices of the pins 112. The shaped edge 114 may be flat, curved, or have any other shape connecting the surfaces or vertices. The shaped edge 114 can be sized to facilitate anchoring of the plurality of beads 130 to the plurality of pins 112. The plurality of pins 112 may have a hexagonal cross-section. Alternatively, the shape of the cross-section of the pins 112 may be, but is not limited to, square, round, rectangular, triangular, diamond shaped, or octagonal.

In some embodiments, the plurality of pins 112 may include a diverse assortment of cross-section shapes, allowing for the engagement of multiple shapes of beads. As depicted in FIG. 11, each of the plurality of pins 112 has a solid interior. In alternative embodiments, the plurality of pins 112 may have a partially hollow or entirely hollow interior. The interior may be configured so that the plurality of pins 112 of a first tray 110 can engage the interior of the plurality of pins 112 of a second tray 110, so that multiple trays 110 can be stacked on top of each other.

Figure 12:
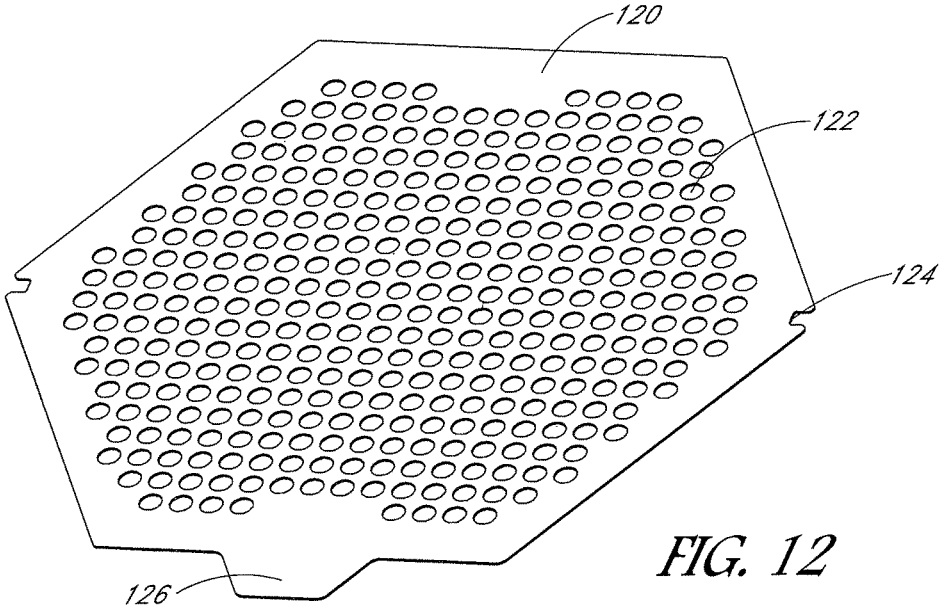
FIG. 12 is a perspective view of the template from FIG. 2.
Figure 13:
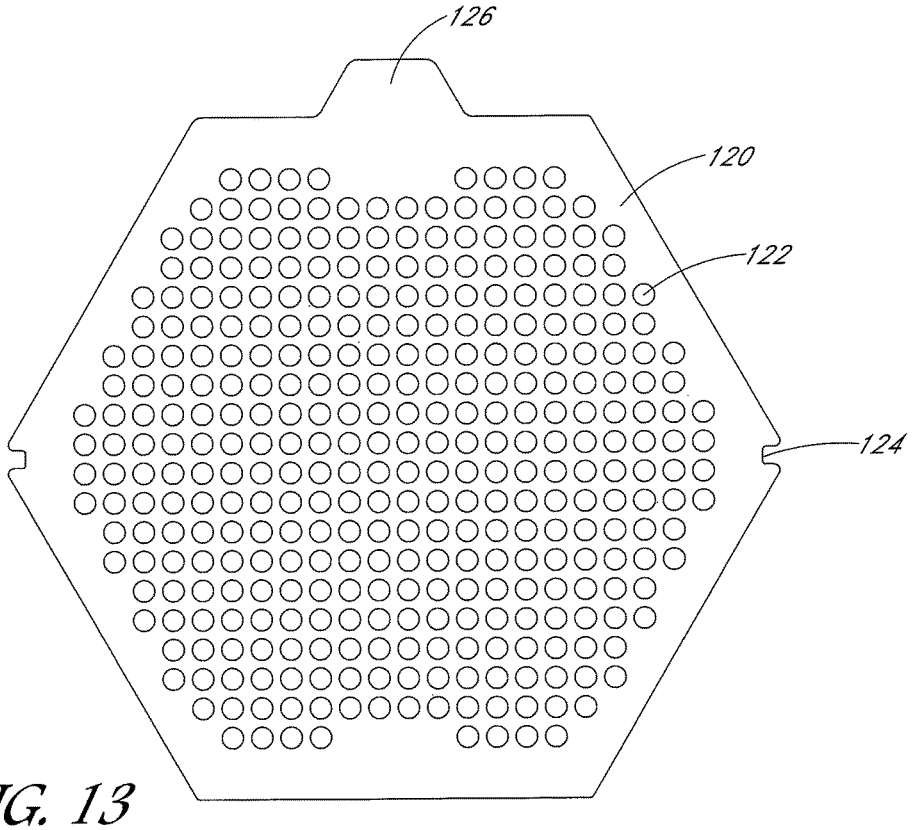
FIG. 13 is a top view of the template of FIG. 12.

FIGS. 12-13 illustrate an embodiment of the template 120 from FIG. 2. FIG. 12 shows a perspective view of the template 120. FIG. 13 shows a top view of the template 120. In certain embodiments, the template 120 includes the plurality of apertures 122. In certain embodiments, the template 120 includes one or more notches 124 and a tab 126.

The template 120 may be made of any material. For example, in certain embodiments the template 120 comprises polypropylene ("PP"). The template can also comprise acrylonitrile butadiene styrene ("ABS"). The plurality of apertures 122 is arranged so as to register with the plurality of pins 112 when the template 120 is disposed on the tray 110. The template 120 may be flexible, allowing for manipulation of sections of the template 120 to facilitate engagement to or removal from the tray 110. The template 120 can also comprise a hard rigid material to facilitate removal of the array of beads 130. In certain embodiments, the template 120 includes both flexible and rigid sections.

The tab 126 of the template 120 does not include apertures and can be configured to extend beyond an edge of the tray 110. The tab 126 can provide a surface for a drawing, text, or logo. The tab 126 may also provide a handle for a user adjusting or removing the template 120. The template 120 can include a design in the area having the plurality of apertures 122, such as the design 228, as depicted in FIG. 2. The template 120 may include a different design on both sides. In some embodiments, the tab 126 can include a small representation of the design 228. The template 120 can also be transparent or semitransparent, and can allow for a design on the top surface of the tray 110 to be visible through the template 120.

In certain embodiments, the template 120 is used primarily for removal of the plurality of beads 130. In certain embodiments, the system 100 may include a secondary template having the design 228. The secondary template can be configured to engage the plurality of pins 112 between the tray 110 and the template 120 or between the template 120 and the plurality of beads 130. The secondary template may also be configured for placement beneath the tray 110. In such embodiments, the tray 110 and template 120 can comprise a transparent or semi-transparent material to allow the design 228 to be visible when placing the plurality of beads 130. The secondary template may also be configured for use separate from the tray 110 and template 120 as a design reference.

The one or more notches 124 can be configured to engage with the one or more protrusions 115 of the tray 110, as depicted in FIG. 1. When the notches 124 are engaged with the protrusions 115, rotary movement of the template 110 relative to the tray 110 can be inhibited. The notches 124 may be configured so that the template 120 can be clocked in a particular orientation when engaged with the protrusions 115. For example, the notches 124 can be configured so that a design on the template 120, such as design 228 depicted in FIG. 2, can be oriented in a particular direction.

Figure 14:
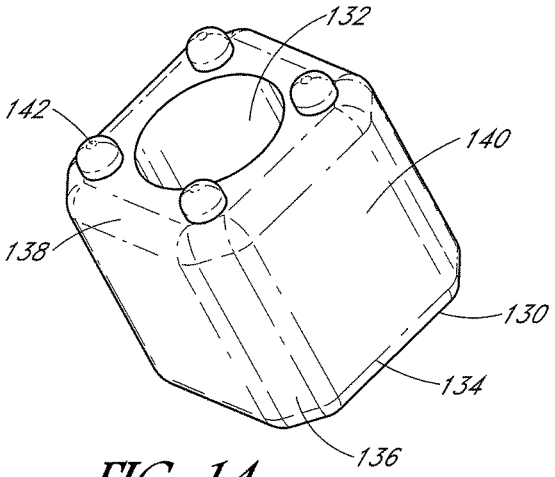
FIG. 14 is a bottom perspective view of one of the plurality of beads from FIG. 2.
Figure 15:
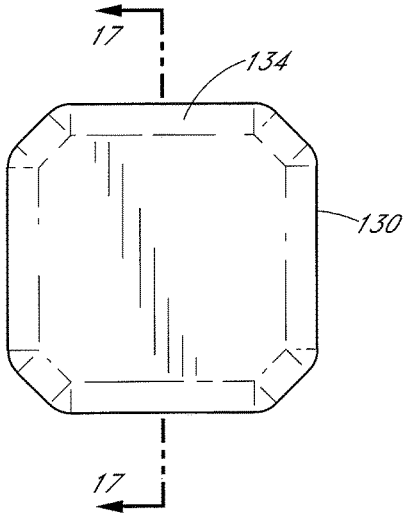
FIG. 15 is a top view of the bead of FIG. 14.
Figure 17:
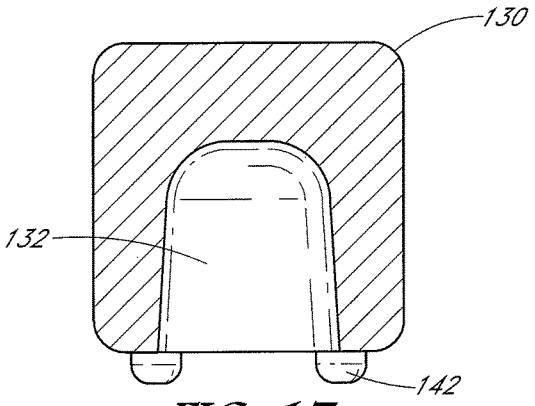
FIG. 17 is a cross-sectional view of the bead of FIG. 14 taken along line 17-17 as depicted in FIG. 15.
Figure 16:
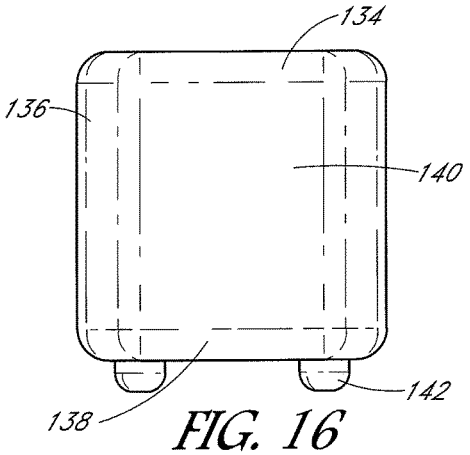
FIG. 16 is a side view of the bead of FIG. 14.
Figure 18:
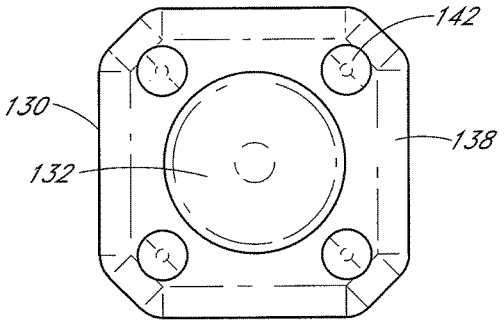
FIG. 18 is a bottom view of the bead of FIG. 14.

FIGS. 14-18 illustrates an embodiment of one of the plurality of beads 130. FIG. 14 illustrates a bottom perspective view of one of the plurality of beads 130. FIG. 15 illustrates a top view of one of the plurality of beads 130. FIG. 16 illustrates a side view of one of the plurality of beads 130. FIG. 17 illustrates a cross-sectional view of one of the plurality of beads 130 taken along line 17-17 of FIG. 15. FIG. 18 illustrates a bottom view of one of the plurality of beads 130. In certain embodiments, each of the plurality of beads 130 includes a receptacle 132. The plurality of beads 130 may include one or more chamfered or radiused edges, such as shaped edges 134, 136, 138. Each shaped edge 134, 136, 138 forms a transition surface between surfaces 140 or vertices of the beads 130. One or more of the shaped edges 134, 136, 138 may be flat, curved, or have any other shape connecting the surfaces 140 or vertices. In certain embodiments, each bead 130 includes one or more dimples 142.

The plurality of beads 130 can be made of a material that allows for adhesion or fusion once dry after liquid is applied. For example, the material may be primarily polyvinyl alcohol ("PVA"). The plurality of beads 130 can be made in a variety of different polygonal shapes and colors. For example, the beads 130 can include cubes, pyramids, cones, cylinders, spheres, hemispheres, polyhedrons, or combinations of various shapes. In some embodiments, a plurality of beads 130 can include multiple different shapes of beads 130. In some embodiments, the beads 130 can be configured to change color in response to, for example, the application of liquid. Each of the plurality of beads 130 can be sized and shaped to achieve contact with one or more adjacent beads 130 so as to adhere or fuse to the one or more adjacent beads 130 once dry after liquid is applied.

The receptacle 132 in each bead 130 is configured to engage one of the plurality of pins 112 as depicted in FIG. 1. The plurality of pins 112 and the receptacles 132 can be configured so that the beads 130 removably anchor to the tray 110 when engaged to the plurality of pins 112 and form an array of beads 130. The cross-sectional shape of the receptacle 132 can be hexagonal, square, round, rectangular, triangular, diamond shaped, or octagonal. The plurality of beads 130 can include beads 130 having different cross-sectional shapes.

The one or more edges 134, 136, 138 can be configured to facilitate liquid contacting adjacent beads 130. For example, the edge 134 is a radius and disposed on an edge of a top surface of the bead 130. The edge 134 can be configured to form a channel or partial gap for liquid to penetrate below the top surface of the plurality of beads 130 and between adjacent beads 130, as further depicted in FIGS. 19-21. The edge 136 is disposed on an edge of the side surface 140 of the beads 130. The edge 136 can be configured so as to form a channel or partial gap for liquid to flow from a top surface of the bead 130 towards a bottom surface of the bead 130, as further depicted in FIGS. 19-21. The edge 138 is disposed on an edge of a bottom surface of the bead 130. The edge 138 can be configured to form a channel or partial gap for the liquid to flow across the surface of the tray 110 and between adjacent beads 130 in the plurality of beads 130.

The sides 140 of each of the beads 130 can be substantially smooth and uniform. Having a gate mark on a side of a bead 130 can affect the bond between beads when liquid is applied. In some embodiments, a width of one or more of the edges 134, 136, 138 is selected to support a gate so that the gate does not interfere with the sides 140 of the beads 130. In some embodiments, the plurality of beads 130 may have one or more sharp edges that do not include a chamfer or radius.

The one or more dimples 142 extend from the bottom surface of the bead 130 to provide a gap or space between the bead 130 and the template 120 when the bead 130 is engaged with the pin 112. For embodiments that do not include the template 120, the one or more dimples contact the tray 110. The dimples 142 can be configured to provide a gap between the bottom surface of the bead and the surface of the tray 110 or the template 120. The gap may prevent the adherence of the bottom surface of the bead 130 to the template 120 at locations between the dimples 142. The dimples can be disposed around the periphery of the receptacle 132. In some embodiments, each of the plurality of beads 130 can include four dimples 132. The dimples may have rounded edges for contacting the surface of the tray 110 or the template 120.

In some embodiments, the plurality of beads 130 can include dimples 142 on multiple surfaces of the plurality of beads 130. For example, the plurality of beads 130 can include one or more dimples 142 on the top surface and bottom surface of each bead. In certain embodiments, the dimples 142 can be configured to allow liquid to flow between the multiple layers of the plurality of beads 130. The dimples 142 can allow for one or more of the plurality of beads 130 to be stacked on top of other beads in the plurality of beads 130 to form a three dimensional object. In certain embodiments, beads 130 not having dimples 142 are stacked on beads 130 which increases the contact or fused area between the layers of beads 130.

In some embodiments, one or more of the plurality of beads 130 can include a pin or stud on the top surface of each bead 130. The pin or stud can be configured to engage a receptacle 132 of one of the plurality of beads 130. The pin or stud can be shaped like one of the pins 112 of the tray 110, allowing for multiple vertical layers of beads 130 creating the three dimensional object. In certain embodiments, the pins or studs are located on the top surface of the bead 130 to allow stacking of beads 130 forming straight columns of beads 130 or to allow beads 130 to be stacked over two side-by-side beads 130. For example, half of a stacked bead 130 could be over one of the side-by-side beads 130 while the other half of the stacked bead 130 is over the other one of the side-by-side beads 130.

In some embodiments, each of the receptacles 132 of the beads 130 can be configured to extend through to the top surface of the bead 130. In such an embodiment, a length of the pin 112 can be selected to enter the bottom surface of the bead 130 and protrude from the top surface of the bead 130, allowing for one or more other beads 130 to engage the pin 112 creating the three dimensional object.

In certain embodiments, one or more of the pins 112 are releasable from the tray 110. In such an embodiment, a user may press one or more of the pins 112 into recesses or holes in the tray 110 or remove one or more of the pins 112 from the recesses or holes.

In certain embodiments, the one or more pins 112 may have variable lengths or heights. In embodiments where the one or more pins 112 are releasable from the tray 110, the user may select certain length pins 112 to press into certain recess or holes in the tray 110 to create a framework for arranging one or more stacks of beads 130 on the tray 110 into the three dimensional object. For example, the user may engage a single bead 130 with a standard length pin 112 of the tray 110 while also stacking two or more beads 130 on a longer length pin 112. In certain embodiments, the one or more pins 112 have the same length while the one or more recesses or holes allow the user to vary how much each of the one or more pins 112 is placed in the recess or hole creating the framework for arranging one or more stacks of beads 130 on the tray 110 into the three dimensional object. To facilitate the user selecting the correct depth of insertion for the one or more pins 112, the pins 112 and or recesses or holes may include one or more index marks along the length of the one or more pins 112 or along the length of the recess or hole. In this way, variable portions of the pins 112 extend above and below the tray 112.

In some embodiments, a three dimensional building system may also be provided that can allow for the layering of multiple two dimensional arrays of beads 130 to create a three dimensional object. Such a system can be configured to align multiple layers of beads in the absence of the plurality of pins 112. For example, a three dimensional printer may be used to orient and place multiple layers of beads 130.

Figure 19:
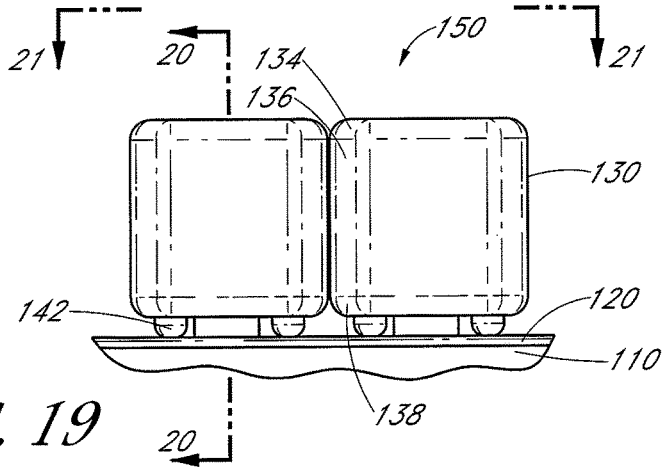
FIG. 19 is a side view of a section of the toy system of FIG. 1 showing the plurality of beads attached to the pins of the tray with the template therebetween.
Figure 20:
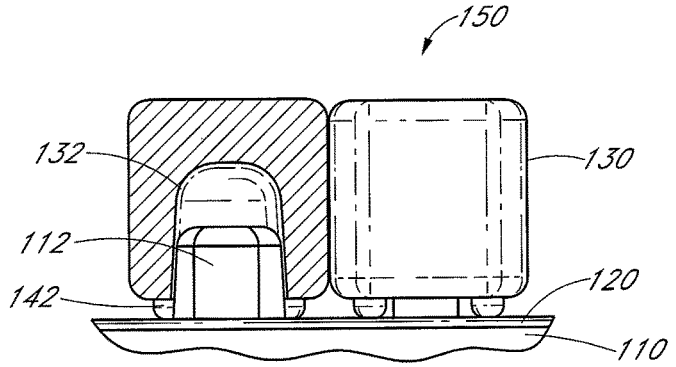
FIG. 20 is a partial cross-sectional view taken along line 20-20 in FIG. 19 through one of the plurality of beads showing the bead engaged with the pin of the tray.
Figure 21:
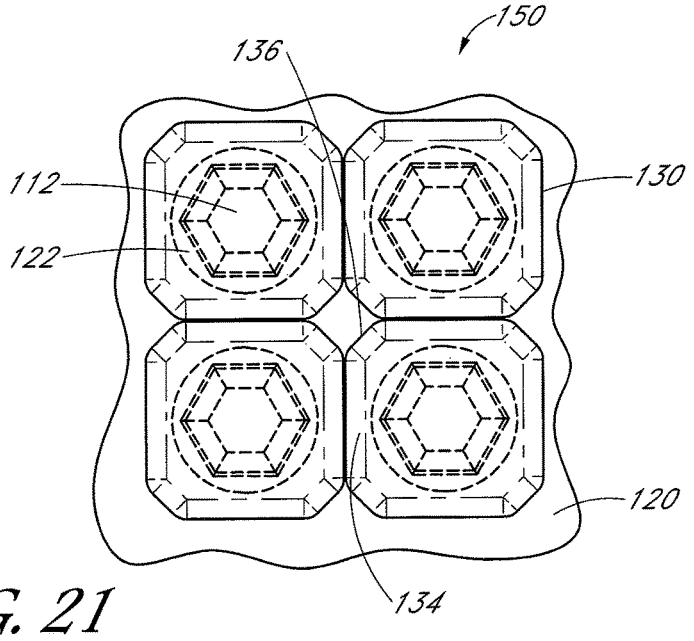
FIG. 21 is a top view of the section of FIG. 19 in which internal surfaces and features of the plurality of beads and pins are shown by dashed lines taken along line 21-21 as depicted in FIG. 19.

FIGS. 19-21 illustrate a portion 150 of the toy system 100 from FIG. 1. FIG. 19 is a side view of the section showing the plurality of beads 130 attached to the pins 112 of the tray 110 with the template 120 therebetween. FIG. 20 is a partial cross-sectional view taken along line 20-20 in FIG. 19 through one of the plurality of beads 130 showing the bead 130 engaged with the pin 112 of the tray 110. FIG. 21 is a top view of the section of FIG. 19 in which internal surfaces and features of the plurality of beads 130 and pins 112 are shown by dashed lines taken along line 21-21 as depicted in FIG. 19.

FIGS. 19-20 show the dimples 142 in contact with the template 120. The dimples 142 can be configured to break the surface tension between the bottom surface of the plurality of beads 130 and the tray 110 or the template 120. This can reduce adherence by the plurality of beads 130 to the tray 110 or the template 120. The dimples can be configured to allow for draining of liquid from the tray 110 or template 120 below the plurality of beads 130 by providing an increased area over which the liquid can flow. This can prevent pooling of liquid in areas below the plurality of beads 130, which can prevent drying of the beads after liquid is applied. In some embodiments, the receptacle 132 and the pins 112 can be configured so that when the plurality of beads 130 are engaged to the pins 112, the bottom surface of the plurality of beads 130 does not engage the surface of the template 120 or the tray 110, in the presence or absence of dimples 142.

FIGS. 19-21 show edges 134, 136, 138. As discussed above with reference to FIGS. 14-18, the edges 134, 136, 138 can be configured to allow for the flow of liquid between adjacent beads in the plurality of beads 130 and between the plurality of beads 130 and the tray 110 or template 120.

The cross-sectional view depicted in FIG. 20 illustrates one of the plurality of pins 112 engaging the receptacle 132 of one of the plurality of beads 130. As described with reference to FIGS. 9-11 and 14-18, the plurality of pins 112 and the receptacles 132 can be configured to removable engage.

FIG. 19-21 show the plurality of pins 112 and the plurality of apertures 122 below the plurality of beads 130. The apertures 122 of the template 120 can be configured so that the template 120 cannot be removed from the tray 110 without removing the plurality of beads 130. For example, each of the plurality of apertures 122 can have a diameter less than a diameter of each of the plurality of beads 130. Alternatively, each of the plurality of apertures 122 can have a shape different than the peripheral shape of each of the plurality of beads 130 so that at least part of the peripheral shape of each of the plurality of beads 130 extends beyond each of the plurality of apertures 122. Thus, the template 120 can be configured to allow for the removal of the plurality of beads 130 by the removal of the template 120. This allows for removal of the dry plurality of beads 130 after liquid has been applied and the beads 130 have adhered or fused together by lifting the template 120 away from the tray 110. Of course, the wetted plurality of beads 130 are preferably left to dry for a portion of time, such as twenty minutes, one hour, or overnight, before attempting to remove the plurality of beads 130 from the tray 110.

Alternatively, the toy system 100 may be configured so that the user can remove the plurality of beads 130 by pulling on one or more of the plurality of beads 130 in a direction away from the tray 120 or by applying a force to the surface of the plurality of beads 130 facing the template 120. The system 100 may further include a tool configured to fit between one or more beads of the plurality of beads 130 or under the plurality of beads 130. The tool can be configured to fit between the plurality of beads 130 and the tray 110 or template 120 and to allow for removal by applying a force to the tool.

While the above detailed description has shown, described, and pointed out novel features of the development as applied to various embodiments, it will be understood that various omissions, substitutions, and changes in the form and details of the devices illustrated may be made by those skilled in the art without departing from the spirit of the development. As will be recognized, the present development may be embodied within a form that does not provide all of the features and benefits set forth herein, as some features may be used or practiced separately from others. All changes which come within the meaning and range of equivalency of the claims are to be embraced within their scope.

The foregoing description details certain embodiments of the systems, devices, and methods disclosed herein. It will be appreciated, however, that no matter how detailed the foregoing appears in text, the systems, devices, and methods may be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment may be included with other depicted embodiments in any combination. For example, any of the various components described herein and/or depicted in the Figures may be combined, interchanged or excluded from other embodiments.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The term "comprising" as used herein is synonymous with "including," "containing," or "characterized by," and is inclusive or open-ended and does not exclude additional, unrecited elements or method steps.

The above description discloses several methods of manufacture and materials of the present development. This development is susceptible to modifications in the methods and materials, as well as alterations in the fabrication methods and equipment. Such modifications will become apparent to those skilled in the art from a consideration of this disclosure or practice of the development disclosed herein. Consequently, it is not intended that this development be limited to the specific embodiments disclosed herein, but that it cover all modifications and alternatives coming within the true scope and spirit of the development as embodied in the attached claims.

While the above detailed description has shown, described, and pointed out novel features of the improvements as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others. The scope of the invention is indicated by the appended claims rather than by the foregoing description. All changes which come within the meaning and range of equivalency of the claims are to be embraced within their scope.

What is claimed is:

1. A toy system for creating and fixing an array of polygon shaped plastic beads together to form a design, the system comprising:

a tray having a plurality of pins disposed on an upper surface of the tray;

a plurality of polygon shaped beads made from a material, each bead having a receptacle configured to receive one of the plurality of pins so as to anchor to the tray and form an array, each bead being sized and shaped to achieve sufficient contact with an adjacent bead so as to adhere to the adjacent bead when dry after a liquid is applied to the array so as to form the fused bead design; and a template having a plurality of apertures arranged so as to receive the plurality of pins when the template is disposed between the plurality of beads when anchored to the tray and the upper surface of the tray, the template being rigid to facilitate removal of the fused bead design from the plurality of pins while maintaining the fused bead design intact.

2. The toy system of claim 1, wherein each of the plurality of beads comprises a shaped edge, the shaped edge being disposed so as to facilitate the liquid to contact adjacent beads.

3. The toy system of claim 2, wherein the shaped edge is disposed on an edge of a side surface of the plurality of beads so as to form a channel for the liquid to flow from a top surface of the bead towards a bottom surface of the bead.

4. The toy system of claim 2, wherein the shaped edge is disposed on an edge of a bottom surface of the plurality of beads so as to form a channel for the liquid to flow across the surface of the tray and between adjacent beads.

5. The toy system of claim 2, wherein the shaped edge is disposed on an edge of a top surface of the plurality of beads so as to form a channel for the liquid to penetrate below the top surface and between the adjacent beads.

6. The toy system of claim 2, wherein the plurality of pins have a hexagonal cross-sectional shape.

7. The toy system of claim 6, wherein an edge of a top surface of the plurality of pins has a shaped edge, the shaped edge being sized so as to facilitate anchoring the receptacle of each of the plurality of beads to each of the plurality of pins.

8. The toy system of claim 1, wherein adjacent pins of the tray are spaced apart so that side surfaces of adjacent beads contact each other when the adjacent beads are anchored to the plurality of pins.

9. The toy system of claim 1, wherein the plurality of pins are disposed on the tray in a 2D array of rows and columns.

10. The toy system of claim 1, wherein the plurality of beads are releasably anchored to the plurality of pins of the tray.

11. The toy system of claim 1, wherein each of the plurality of beads has a cubic shape.

12. The toy system of claim 1, wherein each of the plurality of beads comprises one or more projections extending from a surface of the bead facing the tray, the one or more projections being sized to provide a gap between the surface of the bead and the surface of the tray.

13. The toy system of claim 12, wherein the one or more dimples is four projections.

14. The toy system of claim 12, wherein the one or more projections are disposed about a periphery of the receptacle.

15. A toy system for creating and fixing an array of polygon shaped plastic beads together to form a fused bead design, the system comprising:

a tray having a plurality of pins disposed on an upper surface of the tray;

a plurality of beads made from a material, each bead having a plurality of planar outer surfaces and a receptacle, the receptacle being configured to receive one of the plurality of pins so as to anchor to the tray and form an array, each of the plurality of planar outer surfaces being configured to achieve sufficient contact with an adjacent bead so as to adhere to the adjacent bead when dry after a liquid is applied to the array so as to form the fused bead design; and a template having a plurality of apertures arranged so as to receive the plurality of pins when the template is disposed between the plurality of beads when anchored to the tray and the upper surface of the tray, the template being rigid to facilitate removal of the fused bead design from the plurality of pins while maintaining the fused bead design intact.

16. The toy system of claim 15, wherein the material includes Polyvinyl Acetate (PVA).

17. The toy system of claim 15, further comprising a second template configured to be received beneath a bottom surface of the tray.

18. A bead system for releasably receiving a pin of a tray and fusing together with an adjacent bead to form a fused bead design, the pin being disposed on an upper surface of the tray, the bead system comprising:

a bead comprising a body having a plurality of planar outer surfaces, a bottom surface, and one or more projections extending form the bottom surface, the bottom surface having a receptacle extending therethrough and being sized and shaped to releasably receive the pin, each of the plurality of planar outer surfaces being configured to achieve sufficient contact with an outer surface of the adjacent bead to as to adhere to the adjacent bead when dry after a liquid is applied to the bead and the adjacent bead, and each of the one or more projections having a distal end spaced from the bottom surface raising the bottom surface away from the upper surface of the tray when the distal end is in contact with the upper surface of the tray, the raised bottom surface providing a gap for the liquid to flow between the bottom surface and the upper surface of the tray when the receptacle receives the pin and the distal end is in contact with the upper surface of the tray; and a template having a plurality of apertures arranged so as to receive the pin when the template is disposed between the bead when anchored to the tray and the upper surface of the tray, the template being rigid to facilitate removal of the fused bead design from the pin while maintaining the fused bead design intact.

19. The bead system of claim 18, wherein the body includes Polyvinyl Acetate (PVA).

20. The bead system of claim 18, wherein the body has a cubic shape.

* * * * *